US011242955B2

(12) United States Patent
Song et al.

(10) Patent No.: US 11,242,955 B2
(45) Date of Patent: Feb. 8, 2022

(54) METHOD AND SYSTEM FOR OPTIMIZING THE FILLING, STORAGE AND DISPENSING OF CARBON DIOXIDE FROM MULTIPLE CONTAINERS WITHOUT OVERPRESSURIZATION

(71) Applicants: Xuemei Song, East Amherst, NY (US); Shawn M Cecula, Niagara Falls, NY (US); William R Gerristead, Grand Island, NY (US)

(72) Inventors: Xuemei Song, East Amherst, NY (US); Shawn M Cecula, Niagara Falls, NY (US); William R Gerristead, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 59 days.

(21) Appl. No.: 16/671,666

(22) Filed: Nov. 1, 2019

(65) Prior Publication Data

US 2020/0063916 A1 Feb. 27, 2020

Related U.S. Application Data

(62) Division of application No. 15/472,928, filed on Mar. 29, 2017, now Pat. No. 10,508,771.

(Continued)

(51) Int. Cl.
*F17C 5/06* (2006.01)
*F17C 5/00* (2006.01)

(Continued)

(52) U.S. Cl.
CPC ..... *F17C 5/06* (2013.01); *F17C 1/00* (2013.01); *F17C 1/005* (2013.01); *F17C 5/005* (2013.01);

(Continued)

(58) Field of Classification Search
CPC ... B67D 1/04; F17C 1/00; F17C 1/005; F17C 5/005; F17C 7/00; F17C 7/04;

(Continued)

(56) References Cited

U.S. PATENT DOCUMENTS 4,100,537 A ‡ 7/1978 Carlson ..... A61M 16/0051 340/62
4,581,052 A * 4/1986 Adler ..... B01D 9/0059 62/124

(Continued)

FOREIGN PATENT DOCUMENTS

WO 2015153580 A1 10/2015
WO WO-2015153580 A1 ‡ 10/2015 ..... F17C 9/00
WO WO2015/153580 * 8/2019 ..... F17C 5/02

*Primary Examiner* — Timothy L Maust
(74) *Attorney, Agent, or Firm* — Nilay S. Dalal

(57) ABSTRACT

This invention relates to a novel method and system for dispensing CO2 vapor without over pressurization from a system having multiple containers. The system includes one or more liquid containers and one or more vapor containers. The system is designed to operate in a specific manner whereby a restricted amount of CO2 liquid is permitted into the vapor container through a restrictive pathway that is created and maintained by a shuttle valve during the filling operation so that equalization of container pressures is achieved, thereby allowing shuttle valve to reseat when filling has stopped. During use, a pressure differential device is designed to specifically isolate the vapor container from the liquid container so as to preferentially deplete liquid CO2 from the vapor container and avoid over pressurization of the system until the vapor container becomes liquid dry. The system can be operated so that at least 50% of the CO2 vapor product is dispensed from the vapor container.

19 Claims, 8 Drawing Sheets

CO2 Storage and dispensing two container system

Related U.S. Application Data

(60) Provisional application No. 62/438,746, filed on Dec. 23, 2016, provisional application No. 62/315,434, filed on Mar. 30, 2016.

(51) Int. Cl.

| | |
|---|---|
| ***F17C 7/04*** | (2006.01) |
| ***F17C 1/00*** | (2006.01) |
| ***F17C 7/00*** | (2006.01) |
| ***F17C 13/00*** | (2006.01) |
| *B67D 1/04* | (2006.01) |

(52) U.S. Cl.

CPC ..... *F17C 7/00* (2013.01); *F17C 7/04* (2013.01); *F17C 13/002* (2013.01); *B67D 1/04* (2013.01); *F17C 2203/0639* (2013.01); *F17C 2203/0646* (2013.01); *F17C 2203/0648* (2013.01); *F17C 2205/0138* (2013.01); *F17C 2205/0323* (2013.01); *F17C 2205/0338* (2013.01); *F17C 2205/0382* (2013.01); *F17C 2221/013* (2013.01); *F17C 2223/0153* (2013.01); *F17C 2223/035* (2013.01); *F17C 2225/0123* (2013.01); *F17C 2227/043* (2013.01); *F17C 2260/021* (2013.01); *F17C 2260/022* (2013.01); *F17C 2260/042* (2013.01); *F17C 2270/0171* (2013.01); *F17C 2270/059* (2013.01); *F17C 2270/0509* (2013.01); *F17C 2270/07* (2013.01); *F17C 2270/0736* (2013.01)

(58) Field of Classification Search

CPC ..... F17C 13/002; F17C 2203/0639; F17C 2203/0646; F17C 2203/0648; F17C 2205/0338; F17C 2205/038; F17C 2205/0138; F17C 2205/0323; F17C 2227/043; F17C 2270/0171; F17C 2270/0509; F17C 2270/059; F17C 2270/07; F17C 2270/0736; F17C 2260/021; F17C 2260/022; F17C 2260/042

USPC ..... 141/95

See application file for complete search history.

(56) References Cited

U.S. PATENT DOCUMENTS

| | | | | | |
|---|---|---|---|---|---|
| 4,936,343 | A ‡ | 6/1990 | Pruitt | F17C 7/04 | 137/57 |
| 5,113,905 | A * | 5/1992 | Pruitt | F17C 7/04 | 137/539 |
| 5,405,058 | A ‡ | 4/1995 | Kalis | B67D 3/0035 | 222/185.1 |
| 6,003,547 | A * | 12/1999 | Tippmann, Jr. | F16K 24/04 | 137/588 |
| 6,216,302 | B1 ‡ | 4/2001 | Preston | D06F 43/00 | 134/10 |
| 6,442,980 | B2 ‡ | 9/2002 | Preston | D06F 43/00 | 134/107 |
| 6,761,043 | B1 ‡ | 7/2004 | Reznikov | F25D 3/125 | 62/388 |
| 6,817,385 | B1 * | 11/2004 | Sloan | B65B 1/04 | 137/885 |
| 6,889,508 | B2 ‡ | 5/2005 | Leitch | F25J 3/08 | 62/48.1 |
| 7,018,444 | B2 ‡ | 3/2006 | Billingham | B01D 11/0203 | 95/14 |
| 7,258,127 | B1 ‡ | 8/2007 | Schneider | F17C 13/04 | 137/10 |
| 7,766,309 | B1 * | 8/2010 | Smythe | F16K 27/0263 | 261/62 |
| 8,757,437 | B2 ‡ | 6/2014 | Schneider | B67D 1/04 | 222/12 |
| 8,844,555 | B2 * | 9/2014 | Schneider | B67C 3/10 | 137/107 |
| 10,371,318 | B2 * | 8/2019 | Schneider | F17C 5/02 | |
| 2010/0230436 | A1 ‡ | 9/2010 | O'Donnell | F17C 7/00 | 222/63 |
| 2015/0010839 | A1 ‡ | 1/2015 | Yoshida | F17C 5/007 | 429/42 |
| 2015/0020917 | A1 ‡ | 1/2015 | Makinson | F17C 5/02 | 141/4 |
| 2017/0023179 | A1 * | 1/2017 | Schneider | F17C 5/02 | |
| 2017/0284602 | A1 * | 10/2017 | Song | F17C 7/04 | |
| 2017/0328521 | A1 * | 11/2017 | Grabski | F17C 13/025 | |
| 2019/0360639 | A1 * | 11/2019 | Schneider | F17C 9/00 | |

* cited by examiner

‡ imported from a related application

CO2 Storage and dispensing two container system

Pressure differential device integrated with shuttle valve

Vapor product consumption from a conventional liquid and cylinder system

Vapor product consumption from a liquid and vapor cylinder system of the present invention

METHOD AND SYSTEM FOR OPTIMIZING THE FILLING, STORAGE AND DISPENSING OF CARBON DIOXIDE FROM MULTIPLE CONTAINERS WITHOUT OVERPRESSURIZATION

RELATED APPLICATIONS

The present application is a divisional that claims priority to U.S. application Ser. No. 15/472,928 filed Mar. 29, 2017, which claims priority to U.S. Application Ser. No. 62/315,434 filed Mar. 30, 2016 and U.S. Application Ser. No. 62/438,746 filed Dec. 23, 2016, the disclosures of which are hereby incorporated by reference in their respective entireties for all purposes.

FIELD OF THE INVENTION

This invention relates to a novel method and system for delivery of carbon dioxide from multiple containers to an end-user or customer point of use for a variety of applications.

BACKGROUND OF THE INVENTION

Carbon dioxide (CO2) storage and dispensing systems have been used for a variety of applications, including, by way of example, on-site beverage dispensing applications, such as a carbonated beverage dispenser. The beverage industry uses CO2 to carbonate and/or transport beverages from a storage tank to a specified dispensing area.

By way of example, beverages such as beer can be contained in kegs in the basement or storage room and the taps at the bar can dispense the beer. The storage and delivery of beer from the kegs can occur in a keg area that is located away from where the patrons are sitting. In order to transport the beer from the keg area to the serving area, CO2 has generally been delivered as a liquid in cylinders. The liquid CO2 cylinders are connected to the kegs, which can comprise one or several tanks or barrels. CO2 in the liquid CO2 cylinders is not completely filled with liquid, thereby allowing the carbon dioxide to vaporize into a gaseous state, which is then used to carbonate as well as move the desired beverage from the storage room or basement to the delivery area and provide much of the carbonation to the beverages.

Today, the usage of CO2 storage and dispensing systems is widespread. Many conventional CO2 storage and dispensing systems utilize low pressure dewars (e.g., vacuum insulated jacketed containers) which are typically considered a low pressure storage and dispensing system that is filled to no greater than about 300 psig. Notwithstanding the vacuum insulation, the cold CO2 fluid that fills into a liquid CO2 dewar increases in temperature and vaporizes as heat is gained by the dewar. The vapor generates a higher pressure in the dewar, which may require venting to avoid over pressurization. As such, dewar usage is undesirable as it can increase CO2 products losses arising from the need to periodically vent the excess pressure to avoid over pressurization.

As an alternative to dewars, high pressure uninsulated CO2 storage and dispensing systems have been employed in an attempt to increase CO2 product utilization. However, current high pressure uninsulated liquid CO2 storage and dispensing systems can increase the risk of over pressurization. For example, the maximum permitted filling capability for an uninsulated CO2 liquid cylinder is 68 wt % of total weight (based on water weight). In other words, the system should not be filled to more than 68 wt % by water weight. As temperature increases, the liquid CO2 can vaporize into the headspace and expand to a point where the maximum working pressure of the cylinder is exceeded, thereby potentially rupturing the cylinder.

As a means to control the amount of liquid CO2 filled in uninsulated cylinders, multiple cylinders employing liquid and vapor cylinders have been used. A 2:1 volume ratio for the volume of liquid cylinder to vapor cylinder has been generally regarded as safe operating practice within the industry. Specifically, at the 2:1 volume ratio, the volume of the vapor cylinder and an additional 10% headspace in the liquid cylinder in which the liquid cylinders are deemed to be maximally filled as defined hereinabove can create approximately 40% headspace by volume of the combined capacity of the liquid and vapor cylinders. However, this methodology of determining when the system is full poses the risk of overfilling the CO2 liquid containers. Overfilling can also result in the system not operating properly and lead to erratic supply of CO2 vapor product to a customer or end-user.

In view of such drawbacks, there is a need for an improved method and high pressure system for optimizing CO2 filling, storage and dispensing that is not prone to over pressurization.

SUMMARY OF THE INVENTION

As will be described herein, the present invention employs a pressure differential device with shuttle valve between the liquid and vapor CO2 containers to maintain a higher pressure in the liquid container relative to the vapor container during filling and subsequent supply of CO2 vapor product from the vapor container to the customer. During supply of CO2 vapor product to the customer or end-user, vapor transfer from the liquid container to the vapor container is limited until the pressure in the vapor container drops to below a differential pressure set point. This arrangement will preferentially deplete liquid from the vapor container prior to vapor transfer from the liquid container, thereby mitigating the potential of over pressurization of the on-site system. The on-site system as used herein can be advantageously assembled on-site at the end-user or customer premises.

In a first aspect, a method for dispensing CO2 product to an end-user from an on-site carbon dioxide (CO2) multiple container system comprising a liquid CO2 container operatively connected with a vapor CO2 container, said method comprising the steps of: dispensing CO2 vapor substantially from the vapor CO2 container to the end-user; and preferentially depleting CO2 liquid from the vapor CO2 container, such that the dispensing of the CO2 vapor substantially from the vapor CO2 container to the end-user occurs until a pressure difference between the liquid CO2 container and the vapor CO2 container acquires a set point value.

In a second aspect, a method for filling an on-site CO2 delivery system with CO2 to avoid over pressurization, comprising the steps of: providing a liquid CO2 container and a vapor CO2 container operatively connected to the liquid CO2 container; introducing pressurized CO2 fluid into the liquid CO2 container; creating a restricted flow pathway extending from the fill port to the vapor CO2 container in response to the flow of the pressurized CO2 fluid entering the liquid CO2 container; introducing a predetermined portion of the pressurized CO2 fluid through the restricted flow pathway and into the vapor CO2 container;

filling the system with said pressurized CO2 fluid such that a total weight of said pressurized CO2 fluid occupying the system is no more than 68 wt % by water weight.

In a third aspect, an on-site system for selectively filling and dispensing CO2 vapor product from a liquid CO2 container and a vapor CO2 container, respectively, comprising: a liquid CO2 container operably connected to a vapor CO2 container, the liquid CO2 container comprising a fill port to receive pressurized and refrigerated liquid CO2; a shuttle valve comprising a reciprocating piston; a pressure differential device situated between the liquid CO2 container and the vapor CO2 container; the on-site system adapted to switch between a first configuration for filling and a second configuration for use; the on-site system in the first configuration, during filling, that is defined, at least in part, by the pressure differential device activated to an open position, and the shuttle valve configured into a biased state in response to the pressurized refrigerated liquid CO2 pushing the reciprocating piston away from the fill port of the liquid container towards the vapor CO2 container, thereby unobstructing the fill port and preferentially directing a substantial fraction of the flow of the pressurized and refrigerated liquid CO2 into the liquid CO2 container while permitting a portion of the flow of the pressurized and refrigerated liquid CO2 to enter into the vapor CO2 container along a restricted flow path at a second pressure that is substantially equalized with a first pressure in the liquid CO2 container, said restricted flow path created by a clearance between a valve body of the shuttle valve and the reciprocating piston; the on-site system in the second configuration, during use, that is defined, at least in part, by the shuttle valve in an unbiased position that allows fluid communication between the liquid CO2 container and the vapor CO2 container in an amount that is greater than that permitted by the restrictive flow path when the pressure differential device is activated to open at a predetermined pressure difference between the liquid CO2 container and the vapor CO2 container, thereby allowing CO2 fluid to transfer from the liquid CO2 container along an internal pathway of the reciprocating piston of the shuttle valve, through the pressure differential device and into the vapor CO2 container, and further wherein the pressure differential device is activated to close below the predetermined pressure difference, thereby allowing a substantial fraction of the CO2 product to be preferentially dispensed from the vapor CO2 container.

In a fourth aspect, a method for assembling an on-site multiple container system capable of dispensing CO2 vapor product to an end-user or customer, comprising: providing a liquid CO2 container, the liquid CO2 container comprising a fill port to receive pressurized refrigerated liquid CO2; providing a vapor CO2 container that is the same size or larger than the liquid CO2 container; providing a pressure differential device; providing a shuttle valve comprising a reciprocating piston; operably connecting the liquid CO2 container with the vapor CO2 container with a conduit extending between the liquid CO2 container and the vapor CO2 container; configuring the shuttle valve along the conduit extending between the liquid CO2 container and the vapor CO2 container, wherein the shuttle valve is configured into a biased state during filling of the liquid CO2 container in response to receiving pressurized refrigerated liquid CO2 along the fill port whereby the pressurized refrigerated liquid CO2 pushes the reciprocating piston away from the fill port of the liquid container towards the vapor CO2 container, thereby unobstructing the fill port and preferentially directing a substantial fraction of the flow of the pressurized refrigerated liquid CO2 into the liquid CO2 container, while permitting a portion of the flow of the pressurized refrigerated liquid CO2 along a restricted flow path to enter into the vapor CO2 container at a second pressure that is substantially equalized with a first pressure in the liquid CO2 container, said restricted flow path created by a clearance between a valve body of the shuttle valve; configuring the pressure differential device along the conduit extending between the liquid CO2 container and the vapor CO2 container; such that the pressure differential device opens and closes under certain operating conditions, wherein the pressure differential device is set to open at a predetermined pressure difference between the liquid CO2 container and the vapor container thereby allowing CO2 fluid to transfer from the liquid CO2 container along an internal pathway of the reciprocating piston of the shuttle valve and into the vapor CO2 container, and further wherein the pressure differential device is activated to close below the predetermined pressure difference, thereby preventing the transfer of the CO2 fluid from the liquid CO2 container to the vapor CO2 container so as to preferentially dispense CO2 vapor from the vapor CO2 container.

In a fifth aspect, a method for dispensing CO2 product to an end-user from an on-site carbon dioxide (CO2) multiple container system comprising a liquid CO2 container operatively connected with a vapor CO2 container, said method comprising the steps of: dispensing CO2 vapor substantially from the vapor CO2 container to the end-user; and preferentially depleting CO2 liquid from the vapor CO2 container, such that the weight ratio of the CO2 vapor dispensed from the vapor CO2 container to the CO2 vapor dispensed from the liquid container is approximately 1.5:1 or higher as measured prior to (i) a subsequent or successive refill of CO2 liquid into the liquid CO2 container (ii) or a transfer of CO2 fluid from the liquid CO2 container to the vapor CO2 container.

DETAILED DESCRIPTION OF THE INVENTION

Figure 1A:
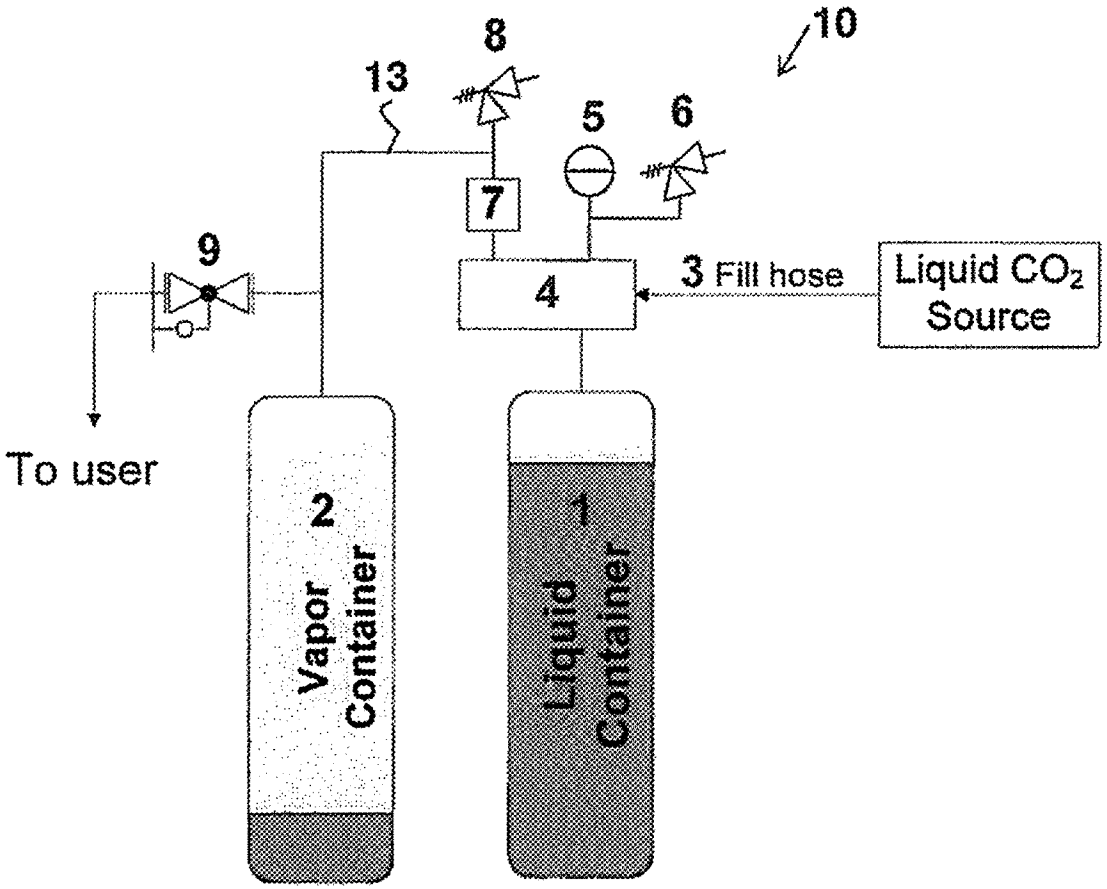
FIG. 1*a* is a process schematic that employs a two cylinder system for dispensing CO2 vapor to an end-user or customer in accordance with principles of the present invention.

As will be described with reference to the Figures, the present invention offers a system for the on-site filling of a carbon dioxide (CO2) container system.

The present invention has recognized that expansion of liquid CO2 and its volume can increase by approximately 30 vol % when the temperature of the liquid cylinder increases from about 0° C. to 20° C. Therefore, an appreciable volume of CO2 can be transferred to the vapor container from the liquid container even though only the liquid cylinder is filled. Thus, the vapor cylinder contains not only vapor but also liquid. Furthermore, during use, more CO2 vaporizes from the liquid cylinder and is consumed by the customer compared to that from the vapor cylinder. Therefore, with subsequent or successive refills, the required volume of the vapor headspace may prove inadequate.

The present invention offers a novel solution for mitigating the risk of insufficient vapor headspace resulting in over-pressurization of a system 10 by preferably consuming CO2 in a vapor container 2 rather than CO2 in a liquid container 1. The system 10 includes a liquid CO2 container 1 and a vapor CO2 container 2 operably connected to the liquid CO2 container 1. As part of the methodology of the present invention, the vapor CO2 container 2 is designed to function as a so-called "virtual headspace" for the liquid CO2 container 1 in a specific manner that avoids over pressurization of the system 10. CO2 vapor product dispenses to an end-user or customer in a controlled manner, whereby the amount of CO2 vapor product dispensed from the vapor CO2 container 2 is maximized, and the amount of CO2 vapor product dispensed from the liquid CO2 container is minimized. In this manner, a substantial portion of the overall CO2 vapor product is obtained from the vapor CO2 container 2. Unlike other CO2 storage and dispensing systems, the present invention limits transfer of CO2 liquid from the liquid CO2 container 1 to the vapor CO2 container 2 until the pressure in the vapor CO2 container 2 has reduced to a certain level, at which point, a pressure differential device is triggered to allow the flow of CO2 fluid from the liquid CO2 container 1 to the vapor CO2 container 2. As such, CO2 liquid is preferentially depleted from the vapor CO2 container 2 prior to transfer of CO2 fluid from the liquid CO2 container 1.

Because of these distinctive operating features, the present invention offers numerous benefits, including, but not limited to, a system that can deliver the proper amount of liquid CO2 while also reducing the hazards associated with overfilling; a system which enables the end-user or customer to continue using the delivery system without interruption even when the system is being filled; a system that does not require an end-user or customer to enter the premises of the on-site dispensing system to shut down or adjust valving before and after delivery of the CO2 liquid; a system that allows automatic re-fill of CO2 fluid into the system at any time of the day or night without any contact with personnel; and a system that can reduce the amount of carbon dioxide vented to the atmosphere due to increase of temperature or as a means of determining a filled system, thereby resulting in less CO2 product waste, less cost to both the customer or end-user and less potential hazards.

It should be understood that the on-site systems of the present invention can include a single liquid CO2 container or multiple liquid CO2 containers directly or indirectly connected to a single vapor CO2 container or multiple vapor CO2 containers. The liquid CO2 container can receive and stores high-pressure liquefied CO2 from a refrigerated CO2 source. In one example, the liquid CO2 container can be refilled with the high-pressure liquefied CO2 from the CO2 source (e.g., automated truck having refrigerated and pressurized CO2 source) by a fill hose. "Fluid" as used herein and throughout means any phase including, a liquid phase, gaseous phase, vapor phase, supercritical phase, or any combination thereof.

"Container" as used herein and throughout means any storage, filling and delivery vessel capable of being subject to pressure, including but not limited to, cylinders, dewars, bottles, tanks, barrels, bulk and microbulk.

"Connected" as used herein and throughout means a direct or indirect connection between two or more components by way of conventional piping and assembly, including, but not limited to valves, pipe, conduit and hoses, unless specified otherwise.

The terms "liquid container" and "liquid CO2 container" as used herein and throughout will be used interchangeably to mean a container that contains substantially liquid CO2. The terms "vapor container" and "vapor CO2 container" will be used interchangeably to mean a container that contains substantially vapor CO2.

The term "conduit", "flow leg" and "pathway" and "flow path" as used herein and throughout are intended to mean" mean flow paths or passageways that are created by any (i) conventional piping, hoses, passageways and the like; (ii) as well as within the valving, such as a shuttle valve.

"CO2 product" and "CO2 vapor product" as used and throughout will be used interchangeably and are intended to have the same meaning.

The present invention in one aspect, and with reference to FIG. 1*a*, has recognized the deficiencies of today's CO2 multiple container dispensing systems and discovered that the vapor CO2 container in such systems may contain CO2 fluid, such as liquid CO2, which may have been transferred and/or condensed in an uncontrolled manner from the liquid CO2 container. The transfer may be occurring during and/or after the filling, storage and/or use of the dispensing system. The transfer of the CO2 fluid into the vapor CO2 container may be occurring as a result of expansion of the liquid CO2 (i.e., an increase in its specific volume) within the liquid CO2 container 1 when the liquid CO2 container 1 increases in temperature after being filled (e.g., walls of the liquid CO2 container 1 absorbing ambient heat from the atmosphere). The expansion of the liquid CO2 in the liquid CO2 container 1 may cause CO2 liquid in the liquid CO2 container 1 to transfer into the vapor container 2. Alternatively or in addition thereto, the expansion of the liquid CO2 or CO2 fluid in the liquid CO2 container 1 may compress the overlying CO2 vapor in the vapor headspace of the liquid CO2 container 1, thereby causing the CO2 vapor to transfer into the vapor CO2 container 2 and form more liquid CO2 in vapor CO2 container 2.

The inventors have observed that this transfer of CO2 fluid from the liquid CO2 container 1 to the vapor CO2 container 2 has a tendency to accumulate CO2 liquid in the vapor CO2 container 2 if the CO2 liquid is not preferentially consumed in the vapor container 2 during usage. "Preferentially consumed during usage" as used herein and throughout means that CO2 vapor product is substantially delivered from the vapor CO2 container 2 to the end-user or customer while CO2 vapor product is limited from the liquid CO2 container 1 until substantially all of the liquid CO2 in the vapor container 2 has vaporized and been dispensed to the end-user or customer. In particular, with regards to conventional systems, after one or more subsequent or successive fills of CO2 liquid into the liquid CO2 container of a multiple container system, the liquid CO2 can accumulate within the vapor CO2 container, particularly when the customer or end-user does not use a significant amount of CO2 between the fills, thereby causing the total amount of CO2 in the system to exceed the maximum permitted filling capability (i.e., greater than 68 wt % based on water weight). In this manner, with regards to conventional systems, the virtual headspace of the vapor CO2 container is reduced, and creates an on-site dispensing system that is potentially over pressurized. An overfilled liquefied CO2 system may experience significant internal pressure excursions and build-up from expansion of the liquid CO2 as it warms. As a result, the present invention has recognized that conventional CO2 storage, filling and dispensing systems are prone to over pressurization.

In accordance with the principles of the present invention, an exemplary system and method for optimizing the filling, storage and dispensing of CO2 from a liquid CO2 container and a vapor CO2 container is provided as will be described in connection with the Figures. It should be understood that FIGS. 1*a*, 1*b*, 1*c*, 1*d* and 3 are not drawn to scale, and some features are intentionally omitted for purposes of clarity to better illustrate the principles of the present invention. FIG. 1*a* depicts the CO2 storage and dispensing system 10. The system 10 can be assembled and installed at a customer site. The dispensing system 10 includes a liquid CO2 cylinder 1 and a vapor CO2 cylinder 2. Although FIG. 1*a* is specifically described with reference to cylinders, it should be understood that any type of container as defined hereinbefore is contemplated by the present invention. Further, although a single liquid CO2 cylinder 1 and a single vapor CO2 cylinder 2 are shown, it should be understood that multiple liquid cylinders and vapor cylinders (or a multiple number of other types of containers) may be used depending on the end-use or customer consumption rates for a particular application.

During the filling and subsequent usage of the system 10, and as shown in FIG. 1*a*, the liquid CO2 cylinder 1 stores a majority of the liquid CO2 while the vapor CO2 cylinder 2 contains mostly vapor CO2 and a minimal amount of liquid CO2, which evaporates and is then preferentially dispensed as vapor product to the customer or end user prior to the transfer of additional CO2 fluid from the liquid CO2 cylinder 1 to the vapor CO2 cylinder 2.

Various sizes of cylinders may be used for the liquid and vapor CO2 cylinders 1 and 2, respectively. Preferably, the vapor cylinder 2 is configured to be the same size or larger in volume than the liquid cylinder 1. As such, in comparison to conventional CO2 storage and dispensing systems, the present invention allows the vapor CO2 cylinder 2 to provide a larger virtual vapor headspace and capacity for liquid expansion therein. This virtual vapor headspace is preserved, in accordance with the principles of the present invention, during filling, storage and use, thereby making the system safer than conventional CO2 storage and dispensing systems.

Suitable materials for the cylinders 1 and 2 may be selected based on operating temperature. Specifically, under certain conditions from the standpoint of materials of construction, the temperature of the liquid CO2 cylinder 1 and vapor CO2 cylinder 2 may be below generally accepted safe limits for common carbon or alloy steel cylinder. Generally speaking, steel's ductile to brittle transition temperature is the result of its (i) alloy composition and (ii) heat treatment. Uncertainties in either property (i) or (ii) during fabrication of the steel cylinder may raise the materials' minimum ductile material temperature (MDMT) to unacceptable levels during filling of the liquid CO2 cylinder 1 with refrigerated CO2. Consequently, in one embodiment of the present invention, alloy steel containers or 6061 T6 aluminum cylinders may be a preferred selection of materials of construction.

In a preferred embodiment, the liquid CO2 cylinder 1 may be filled by a refrigerated liquid CO2 source, such as a CO2 delivery truck that is equipped with a high pressure liquid CO2 pump. The filling is preferably based on pressure, such that when a pre-set fill pressure is reached, the high pressure liquid CO2 pump will stop. Details of the filling and associated pre-fill and leak integrity checks are described in Applicants' docket no. 14104-R2, the disclosure of which is hereby incorporated by reference in its entirety. A CO2 safety interlock fill system provides pre-fill integrity checks for automatically leak checking and pressurizing a fill manifold prior to a subsequent filling operation. Other details for filling from a liquid CO2 source are also described in Applicants' docket no. 14104-US-R2.

Referring to FIG. 1*a*, the refrigerated liquid CO2 (i.e., liquefied CO2) in one aspect of the present invention can be pumped from a delivery truck through fill hose 3 and valve 4 into liquid cylinder 1. The temperature of the refrigerated liquid CO2 in the delivery truck is generally near 0° F.

Figure 1B:
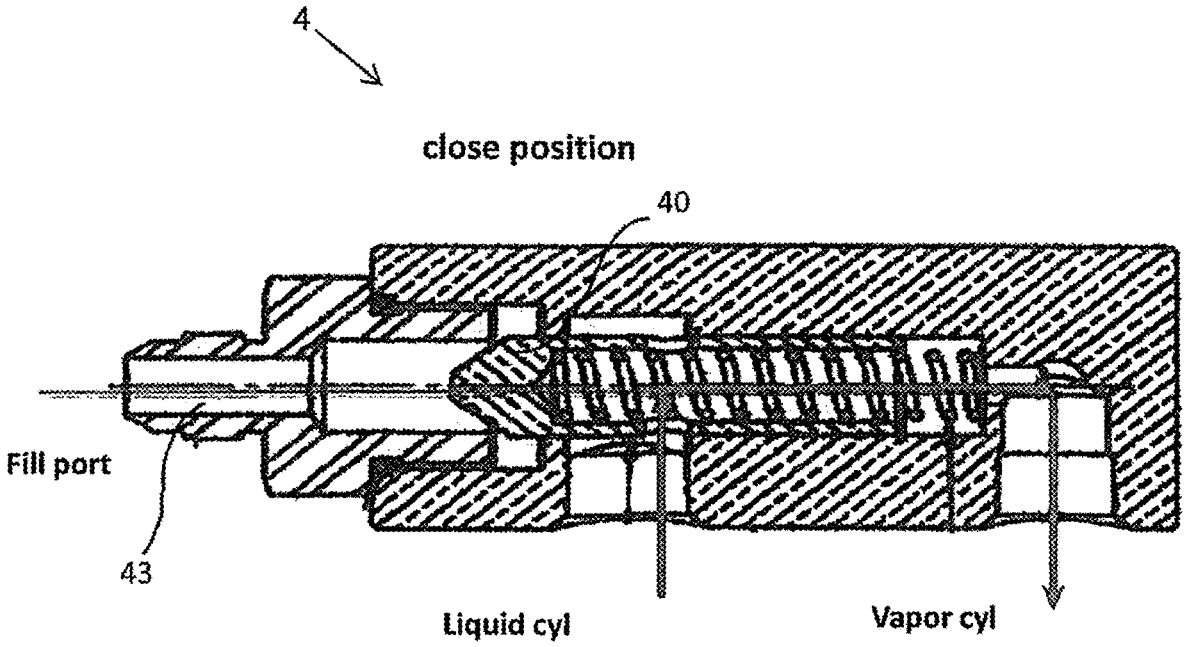
FIG. 1*b* shows a representative shuttle valve specifically employed during the dispensing operation in accordance with the principles of the present invention, whereby the shuttle valve is in an unbiased state such that the fill port of liquid CO2 container is obstructed by the shuttle valve.
Figure 1C:
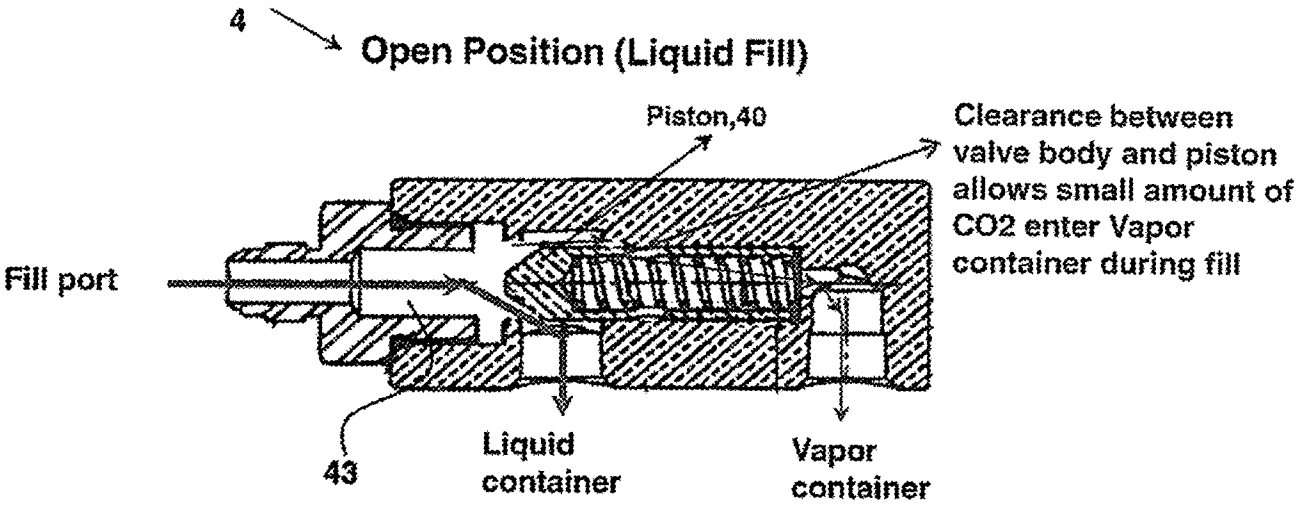
FIG. 1*c* shows the shuttle valve of FIG. 1*b* pushed into a biased state during filling into a CO2 liquid container in accordance with the principles of the present invention whereby the fill port of liquid CO2 container is unobstructed by the shuttle valve.

Valve 4 is preferably a specially designed shuttle valve suitable for use in the CO2 storage and dispensing system 10 of the present invention. The valve 4 includes a reciprocating shuttle valve, which is preferably spring-based. FIGS. 1*b* and 1*c* show a representative example of the operation of such a shuttle valve 4. Other structural elements of the system 10 have been omitted from FIGS. 1*b* and 1*c* for purposes of clarity. During normal operating mode (i.e., FIG. 1*b* where the liquid CO2 cylinder 1 is not being filled with pressurized CO2 from a CO2 source), the piston 40 is unbiased so that the flow path from fill hose 3 to liquid container 1 is normally closed by piston 40 and restricted flow path from liquid CO2 cylinder 1 to vapor CO2 cylinder 2 is normally open which allows restricted flow form the liquid cylinder 1 into the vapor cylinder 2. The restricted flow path can be created by virtue of a passageway extending within the piston 40 and into the vapor cylinder 2. A greater amount of CO2 fluid flow towards the vapor container 2 can occur when the shuttle valve 4 is unbiased as shown in FIG. 1*b* (given that the pressure differential device 7, which is situated between the containers 1 and 2, is in the open position) compared to when the shuttle valve 4 is biased such that there is no continuous flow path from the liquid container 1 to the vapor container 2 as shown in FIG. 1*c*, but for a narrow passageway from fill port 43 to the vapor port by way of a clearance or gap between the valve body and the piston 40.

The filling operation in one aspect of the present invention will be explained. Referring to FIG. 1*a*, fill hose 3 is connected between the CO2 delivery source and the shuttle valve 4. The CO2 delivery source (i.e., "CO2 source") is preferably a refrigerated CO2 delivery truck. After completion of pre-fill and leak integrity checks as more fully described in Applicants'Ser. No. 15/472,997 the refrigerated CO2 liquid exits the CO2 source, and then can be pressurized by a pump, such as a high pressure liquid CO2 pump as may be commercially available. The liquid CO2 pump, which may be part of the delivery truck, pressurizes the liquid CO2 that exits from the CO2 source. The filling is preferably based on pressure, such that when a pre-set fill pressure is reached, the liquid CO2 pump will stop. For low pressure applications, the pre-set fill pressure may be about 300-400 psig. For filling an uninsulated container which requires relatively high pressure, the pre-set fill pressure needs to be greater than the vapor pressure of the CO2 in the uninsulated container, e.g. greater than 850 psig, preferably greater than 950 psig and more preferably greater than 1100 psig. The pressurized and refrigerated liquid CO2 flows through fill hose 3 and into the shuttle valve 4. The pressurized and refrigerated liquid CO2 exerts a force that pushes the piston 40 of shuttle valve 4 forward from the unbiased position of FIG. 1*b* to the biased position of FIG. 1*c*. The movement of the piston 40 unobstructs the fill port 43 and creates a flow path for liquid CO2 to enter into liquid CO2 cylinder 1. The positioning of the piston 40 as shown in FIG. 1*c* substantially blocks the flow path from liquid cylinder 1, through the internal passageway of the piston 40 and into the vapor cylinder 2. The opening into the internal passageway of piston 40, through which CO2 from the liquid container 1 can enter into the piston 40, is blocked by the valve body of piston 40, as shown in FIG. 1*c*. In other words, the flow path of FIG. 1*b* along the internal passageway of piston 40, designated by arrows from liquid cylinder 1 to vapor cylinder 2, does not exist when the piston 40 is configured in its biased state as shown in FIG. 1*c*. Thus a significant volume of the liquid cylinder 1 can be preferentially filled with the incoming pressurized and refrigerated liquid CO2. However, a specially designed gap or clearance between the housing of the valve body 4 and piston 40 as indicated by the arrow in FIG. 1C allows restricted flow from the fill port 43 into the vapor cylinder 2 during the fill (as shown by arrows in FIG. 1*c*). In one embodiment of the present invention, a clearance between the valve body 4 and piston 40 is no more than about 0.003 inches to create less than about 25 wt % of the total CO2 fluid that is charged into the system 10 to enter into the vapor container 2 with the balance (i.e., 75 wt % of the total CO2 charged) occupying the liquid container 1. Preferably, the CO2 enters the vapor container 2 at a fill rate range of about 20-30 lb/min. Accordingly, a controlled amount of restricted flow of CO2 fluid enters into the vapor cylinder 2 during liquid filling (FIG. 1*c*).

A pressure differential device 7, which can be located on the vapor port of the shuttle valve 4 and which is situated between the liquid cylinder 1 and the vapor cylinder 2 (FIG. 1*d*), can be tuned to remain open during the filling operation as the pressurized CO2 refrigerated fluid exerts sufficient force against the valve element (e.g., ball valve) of the pressure differential device 7. In one example, the pressure differential device 7 is open as a result of being set at about 25 psig, while the vapor pressure of CO2 is 800 psig, and the pumping pressure of CO2 liquid is about 1100 psig. It should be understood that the pressure differential device 7 provides specific desired functionality during CO2 delivery to the end-user or customer, but not during the fill operation. In other words, the pressure differential device 7 is selectively utilized during use of the system 10 for CO2 vapor dispensing, as will be explained in greater detail below.

Contrary to conventional on-site CO2 filling processes which generally tend to fully isolate the vapor cylinder 2 from liquid cylinder 1 during filling of CO2 into the system 10, the present invention deliberately avoids complete isolation of the vapor cylinder 2 from the liquid cylinder 1 during the filling operation. The ability to allow a restricted amount of CO2 liquid into the vapor cylinder 2 through a restrictive pathway created and maintained during filling appears counterintuitive to the design objective of creating and preserving the vapor headspace of the vapor container 2. However, the relatively small amount of CO2 introduced into the CO2 vapor cylinder 2 can exert a certain pressure that allows for pressure equalization between both sides of the shuttle valve 4 and ultimately can substantially balance the pressure between liquid cylinder 1 and vapor cylinder 2, thereby allowing the return of the piston 40 towards the fill port 43 when the filling of the pressurized and refrigerated CO2 into the liquid CO2 cylinder 1 is completed, and the liquid CO2 pump has shut off. The ability for the piston 40 to reseat occurs without introducing a significant amount of CO2 liquid into the vapor container 2 that reduces the vapor headspace of the vapor cylinder 2. Accordingly, the filling operation allows substantial CO2 loading into the liquid cylinder 1 while minimizing liquid CO2 into the vapor cylinder 2 to preserve the vapor headspace of the vapor container 2. Without a restrictive passageway created from fill port 43 and along the clearance or gap between the valve body and piston 40, the piston 40 may not reliably reseat onto the fill port 43. The undesirable result is substantial isolation of the vapor cylinder 2 from the liquid cylinder 1 during CO2 dispensing from the system 10 (i.e., the scenario of FIG. 1*c* where a restricted amount of flow of CO2 fluid occurs which is less flow than that occurring in the unbiased or reseated piston 40 configuration of FIG. 1*b* with pressure differential device 7 in the open state). Substantial isolation of the cylinders 1 and 2 during CO2 dispensing can lead to over pressurization when a sufficient amount of the CO2 fluid in the liquid cylinder 1 cannot transfer into the vapor cylinder 2 under certain operating conditions.

Additionally, when the vapor container 2 does not have significant positive pressure, such as may occur during start up, or during operation when the vapor cylinder 2 has low pressure, the piston 40 may not reseat due to higher pressure on the liquid fill port side of the shuttle valve 4 compared to the vapor fill port side. The liquid cylinder 1 is essentially isolated from the vapor cylinder 2 which potentially creates a hazardous over pressurized condition of the system 10, whereby the pressure in the liquid cylinder 1 can increase. Accordingly, the inclusion of a gap or clearance between the piston 40 of valve 4 and housing of the valve 4 that is in communication with the fill port 43 creates and maintains a restrictive flow path from fill port 43 into the vapor cylinder 2 during the filling operation (as shown by the arrows in FIG. 1*c*) eliminates or significantly reduces the likelihood of over pressurization of the system 10.

As a result, complete isolation of the vapor cylinder 2 from the liquid cylinder 1 during fill is avoided by the present invention, but, in doing so, only a restrictive flow path is created and maintained during filling to allow a limited and controlled amount of CO2 fluid into the vapor cylinder 2 as necessary to reseat the piston 40 and substantially equalize pressures of the cylinders 1 and 2. In one embodiment, the amount of CO2 liquid entering the vapor cylinder 2 is less than 30 wt % of the total incoming flow of pressurized and refrigerated CO2 fluid from the CO2 source during a fill; preferably less than 20 wt %; and more preferably less than 10 wt %.

After filling, the pressure of the liquid cylinder 1 can continue to increasing for many hours as the liquid CO2 will tend to evaporate until equilibrium is achieved. During this equilibrating period, the pressure differential device 7, situated between the liquid cylinder 1 and the vapor cylinder 2, can remain open in response to a predetermined pressure difference between the cylinders 1 and 2, which prevents the liquid cylinder 1 from overpressurizing.

Upon completion of filling, and after the system 10 has stabilized to reach a substantial equilibrium state, the use of the system 10 for dispensing CO2 vapor product to an end-user or customer can occur, as will now be described. It should be noted that initially, during use of the system 10 to dispense CO2 vapor product, the piston 40 of the shuttle valve 4 reseats into its unbiased position and remains in the unbiased position (FIG. 1*b*), and a pressure differential device 7 is initially closed as a result of pressure equalization between the liquid cylinder 1 and vapor cylinder 2. As such, isolation occurs between the liquid cylinder 1 and the vapor cylinder 2, and the restrictive flow pathway created and maintained during filling is eliminated during the dispensing of vapor product from the vapor cylinder 2. It is preferable to maintain a positive pressure difference ranging from 10 to 1000 psig in the liquid cylinder 1 relative to the vapor cylinder 2; preferably 10-500 psig; and more preferably 10-250 psig. The positive pressure ensures that CO2 liquid is consumed from the vapor cylinder 2 before additional CO2 fluid is transferred by the liquid cylinder 1 into the vapor cylinder 2.

Although the piston 40 is not substantially blocking the flow path to the vapor cylinder 2 to create a restrictive flow pathway, as can occur during filling, as will be explained herein below, a pressure differential device 7 is situated between the liquid cylinder 1 and the vapor cylinder 2. The pressure differential device 7 is specifically triggered to open and close under specific operating conditions to preferentially deplete CO2 liquid from the vapor container 2. Specifically, CO2 vapor product is preferentially dispensed from the vapor CO2 container 2 with the pressure differential device 7 in the closed position, until a pressure difference between the liquid CO2 container and the vapor CO2 container acquires a set point value, at which point pressure differential device 7 opens to allow additional CO2 fluid to be transferred from the liquid container 1 to the vapor container 2. Preferably, the pressure differential device 7 is set to a certain pressure difference between the liquid container 1 and the vapor container 2 that must be reached or exceeded before opening to allow CO2 fluid transfer. Alternatively, the pressure differential device 7 can be set to a certain set point that the pressure in vapor container 2 must reach or drop below before opening. The pressure differential device 2 in the open position allows subsequent or successive refill of CO2 liquid into the liquid CO2 container and/or a transfer of CO2 fluid from the liquid CO2 container 1 to the vapor CO2 container 2.

Figure 1D:
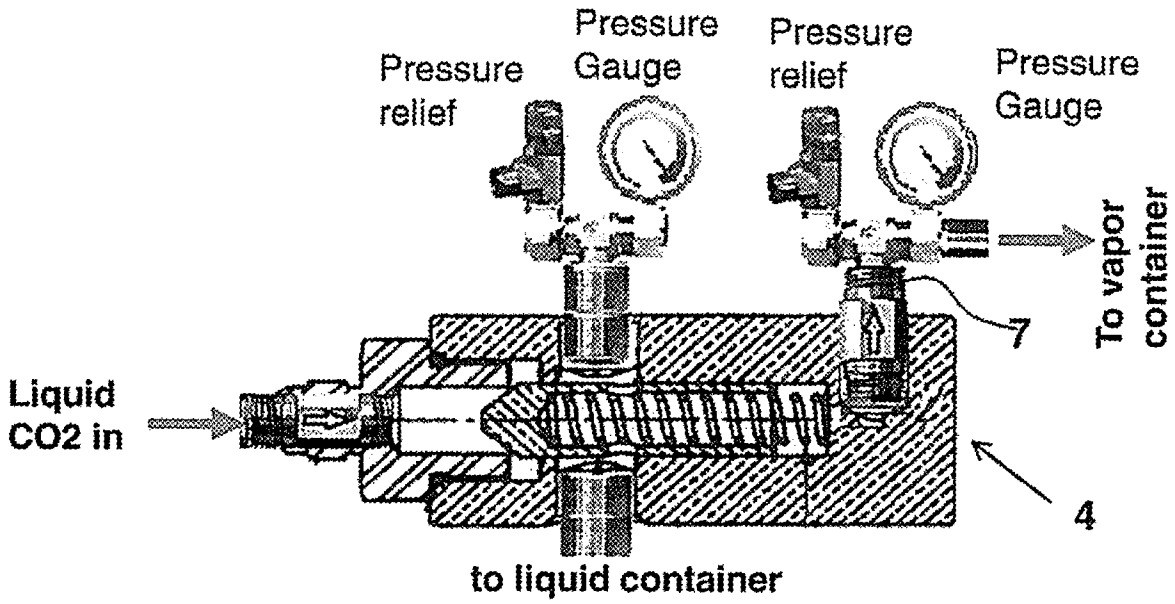
FIG. 1*d* show an exemplary pressure differential device integrated with a shuttle valve in accordance with the principles of the present invention.

The pressure differential device 7 can be installed on the vapor port of shuttle valve 4 as shown in FIG. 1*d*. Alternatively, the pressure differential device 7 can be situated downstream of shuttle valve 4 along the conduit 13 extending between the liquid cylinder 1 and the vapor cylinder 2. FIG. 1*a* is intended to represent the pressure differential device 7 integrated into the vapor port of shuttle valve 4 or the pressure differential device 7 situated downstream of the shuttle valve 4. Any in-line pressure differential device 7 is contemplated, including a critical orifice, capillary, pressure relief valve, active in-line spring-loaded backpressure device and any other suitable device capable of being set to activate into an open position at a predetermined pressure difference between the liquid container 1 and the vapor container 2 so as to maintain limited transfer of CO2 fluid from the liquid container 1 to the vapor container 2 upon preferential depletion of the CO2 liquid from the vapor container 2.

Referring to FIG. 1*a*, during supply to the end-user or customer through a pressure regulator 9, the transfer of vapor CO2 from the liquid cylinder 1 to the vapor cylinder 2 is limited by the pressure differential device 7, until a certain pressure difference between the liquid container 1 and the vapor container 2 is reached. For example, when pressure in the vapor cylinder 2 drops to a certain level that increases the pressure difference between the liquid and vapor cylinders 1 and 2, the pressure differential device 7 (i.e., also referred to as the set point pressure of the pressure differential device 7 or the pressure drop of the pressure differential device 7) is triggered into the open position. The set point pressure or pressure drop of the pressure differential device 7 at which it opens will be set to a level for ensuring that a lower pressure may persist in the vapor cylinder 2 that is designed to primarily supply the CO2 vapor product to the end-user or customer without substantial transfer or supply of vapor CO2 from the liquid container 1, thereby resulting in preferential vaporization and subsequent consumption of the liquid CO2 contained within the vapor cylinder 2. In one example, the set point is 5-100 psi, preferably 10-75 psi and more preferably 10-50 psi. Setting the pressure differential device 7 to activate into the open position when the pressure in the vapor container 2 has reduced to a certain level will preferentially consume liquid CO2 from the vapor cylinder 2 prior to CO2 fluid being transferred from liquid cylinder 1 to the vapor cylinder 2 and/or CO2 vapor withdrawn from the liquid cylinder 1 to the end-user or customer. In one embodiment, so long as the vapor cylinder 2 is not liquid dry, the weight ratio of vapor product dispensed from the vapor cylinder 2 to the vapor product dispensed from the liquid cylinder 1 is approximately 1:1 or higher, preferably about 1.5:1 or higher and more preferably about 2:1 or higher.

Without being bound by any particular theory or mechanism, it is believed that the preferential depletion of CO2 liquid in the vapor cylinder 2 may occur as follows. As CO2 vapor is withdrawn from the vapor cylinder 2, the vapor pressure in the vapor cylinder 2 drops to a level that is lower than the initial vapor pressure corresponding to the initial temperature, which is typically ambient temperature (i.e., the temperature of the premises where the vapor cylinder 2 is located). The reduction in pressure causes liquid CO2 in the vapor cylinder to evaporate to re-establish the vapor pressure in the vapor cylinder 2.

The evaporation of the CO2 liquid requires a heat of evaporation, which can cool the vapor cylinder 2. The cooling of the vapor cylinder 2 causes the overall pressure to drop in the vapor cylinder 2. Accordingly, as CO2 liquid in the vapor cylinder 2 is preferentially vaporized and then dispensed, with the pressure differential device 7 in the closed position, the pressure in the vapor container 2 decreases during operation of the system 10 until the pressure has reduced to a certain level that creates a pressure difference between the liquid container 1 and the vapor container 2 that is equal to or greater than the set point pressure of the pressure differential device 7 at which point the device 7 is triggered to open. Upon the pressure in the vapor container 2 dropping to below the certain level, the pressure differential device 7 is activated into the open position to allow transfer of CO2 fluid from the liquid container 1 to the vapor container 2. It should be noted that the shuttle valve 4 remains in the unbiased position (FIG. 1*b* and FIG. 1*d*) and therefore does not restrict transfer of CO2 fluid from the liquid cylinder 1 to the vapor cylinder 2. In other words, CO2 fluid can enter into the hollow passageway of piston 40 and flow therealong and enter into vapor container 2 (as indicated by the lines with arrows in FIG. 1*b*) because the openings into the hollow passageway of piston 40 are not blocked by the valve body.

CO2 fluid transfer into the vapor cylinder 2 occurs along conduit 13 until the pressure in the vapor cylinder 2 has increased to above a predetermined level so as to decrease the pressure difference between the liquid cylinder 1 and the vapor cylinder 2 below the set point pressure of the pressure differential device 7, at which point the pressure differential device 7 switches from open to the closed position. In this manner, the present invention establishes the set point pressure of the pressure differential device 7 to be an operating value that allows preferential depletion of CO2 liquid from the vapor cylinder 2, thereby reducing or eliminating the risk of over pressurization arising from accumulation of the CO2 liquid level in the vapor cylinder 2—a methodology not previously employed with currently utilized on-site CO2 dispensing systems.

The present invention has discovered without use of the pressure differential device 7 in the manner herein described, during the supply of CO2 vapor product to the customer, CO2 in the liquid cylinder 1 vaporizes and flows into the CO2 vapor cylinder 2 and/or directly to the end-user, until a pressure equilibrium is established in both the liquid cylinder 1 and the vapor cylinder 2. Since the liquid cylinder 1 generally contains more liquid CO2 than the vapor cylinder 2, the evaporation rate of the CO2 liquid in the liquid cylinder 1 is typically faster than in the vapor cylinder 2. Consequently, more CO2 from the liquid cylinder 1 is observed to be dispensed to the customer or end user. As a result, the liquid CO2 in the vapor cylinder 2 may undergo a slower rate in depletion, which could cause accumulation in the vapor cylinder 2 during CO2 fluid transfer from the liquid cylinder 1 to the vapor container 2, as well as during subsequent filling operations. The net effect would be an increased risk of over pressurization in the vapor cylinder 2, as the vapor space of the vapor cylinder 2 is being reduced during operation.

As can be seen, in accordance with the principles of the present invention, the pressure differential device 7 limits CO2 vapor flow from the liquid container 1 into the vapor container 2 during use when the vapor container 2 contains liquid CO2. Specifically, when the vapor container 2 contains liquid CO2 (i.e., the vapor cylinder 2 is not liquid dry), the pressure differential device 7 limits the transfer of vapor CO2 flow from the liquid container 1 into the vapor container 2 until substantially all of the liquid phase CO2 in the vapor container has been vaporized and subsequently consumed or depleted. In one example, the present invention vaporizes at least 75 wt % of CO2 liquid in the vapor CO2 container prior to introducing CO2 liquid and/or CO2 vapor from the liquid CO2 container to the CO2 vapor container. The present invention utilizes the pressure differential device 7 to isolate the vapor container 2 from the liquid container 1 under such operating conditions to allow the liquid CO2 in the vapor container 2 to be preferentially consumed before the CO2 vapor from the liquid container 1. In this manner, liquid CO2 is prevented from accumulating in the vapor container 2, which consequently minimizes the risk of CO2 overfill and over pressurization of the on-site two container system.

Referring to FIG. 1*a*, an optional pressure gauge 5 may be installed on the liquid port and also vapor port of the shuttle valve 4 to monitor the pressure of liquid container 1. A pressure relief valve 6 may be used to protect the manifold and cylinders 1 and 2. An additional pressure relief valve may be installed on the vapor port of the shuttle valve 4.

The ability of the present invention to preferentially withdraw vapor product from the vapor cylinder 2 as opposed to the liquid cylinder 1 is demonstrated by the tests described in the following Examples.

Comparative Example 1 (Conventional System)

Figure 2A:
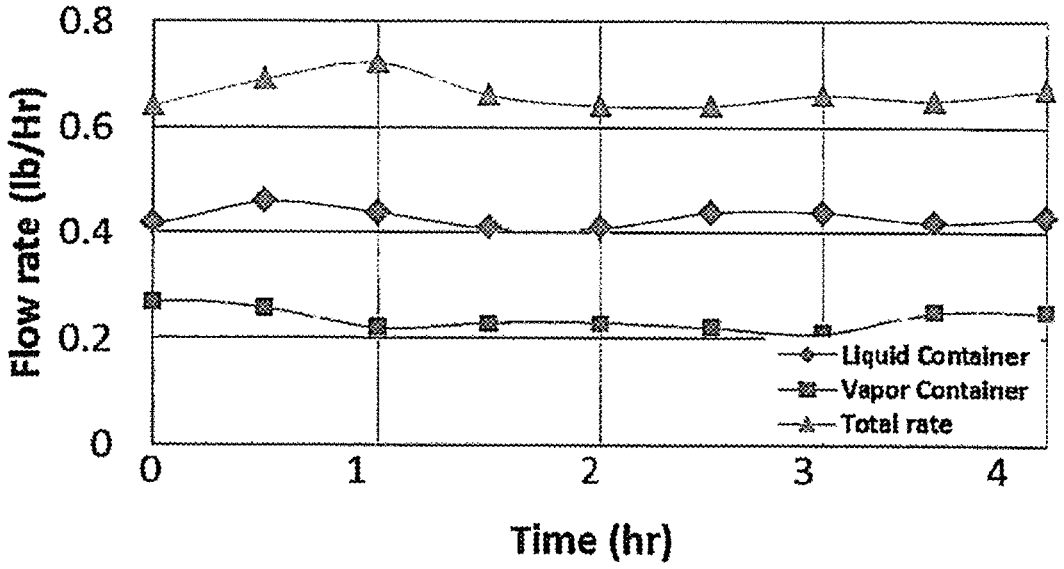
FIG. 2*a* shows weight loss rates of CO2 from a CO2 liquid container and a CO2 vapor container operated by conventional means.

The behavior of a conventional two cylinder CO2 dispensing system was evaluated. The vapor cylinder was not isolated from the liquid cylinder during use. The weight loss of the liquid cylinder and the weight loss of the vapor cylinder were monitored. FIG. 2*a* shows weight loss rates of liquid cylinder and vapor cylinder that were observed during supply to customer at a total flow rate of approximately 0.65 lb/hr. The weight loss of the liquid container was almost 2 times higher than that of the vapor container. The weight ratio of vapor product dispensed from the vapor cylinder 2 to the vapor product dispensed from the liquid cylinder 1 was observed to be approximately 0.5. During the process, the pressure of the liquid container was the same as that of the vapor container.

Example 1 (Present Invention)

Figure 2B:
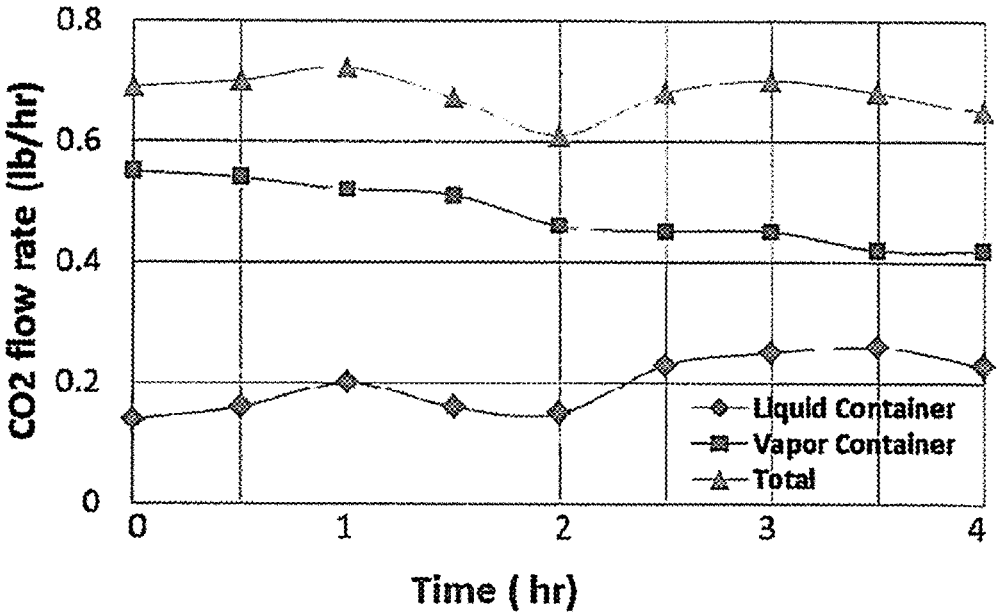
FIG. 2*b* shows weight loss rates of CO2 from a CO2 liquid container and a CO2 vapor container operated in accordance with principles of the present invention.

The behavior of an improved two cylinder CO2 dispending system was evaluated. The system was configured as shown in FIG. 1*a*. The system was operated in accordance with the principles of the present invention. A restrictive flow pathway was created and maintained with the shuttle valve during filling of the liquid cylinder with refrigerated CO2 liquid from a liquid CO2 source. A limited amount of CO2 fluid was permitted to transfer from the liquid cylinder to the vapor cylinder when the pressure of the vapor cylinder was reduced to below a set point value of the pressure differential device, which was a 25 psig check valve (i.e., the check valve was tuned to open at a pressure difference between the liquid and vapor cylinders of 25 psig). The weight loss of the liquid cylinder and the weight loss of the vapor cylinder were monitored. FIG. 2*b* shows the weight loss rates of liquid container and vapor container that were observed during supply to customer at a total flow rate of 0.7 lb/hr with a 25 psi pressure differential device. The weight loss of liquid container was much lower than that of vapor container. The weight ratio of vapor product dispensed from the vapor cylinder 2 to the vapor product dispensed from the liquid cylinder 1 was observed to be approximately 2.5. The results indicated that CO2 vapor product was preferentially dispensed from the vapor cylinder.

Example 2 (Present Invention)

Figure 4:
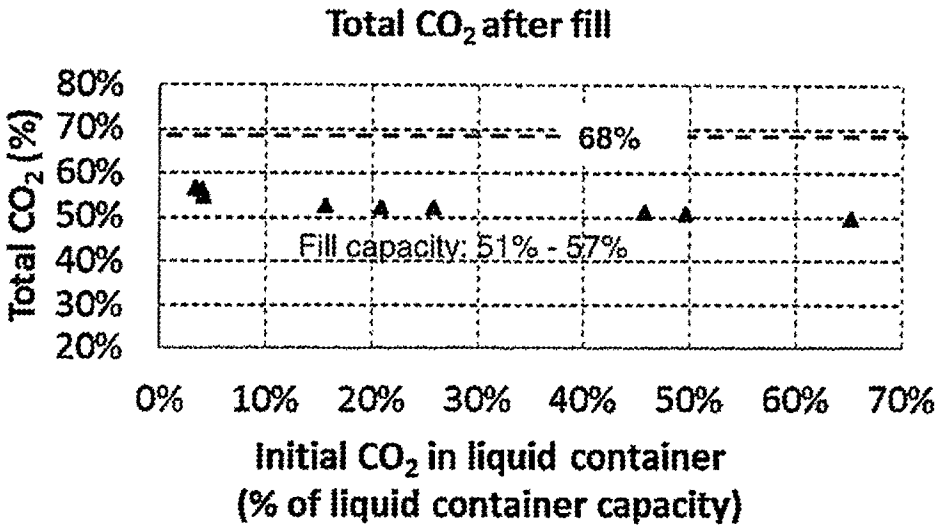
FIG. 4 shows fill capacity behavior into a CO2 liquid container and a CO2 vapor container operated in accordance with the principles of the present invention.

The system of FIG. 1*a* was tested to determine fill capacity behavior. The system was operated in accordance with the principles of the present invention. The system included a 37 L liquid container and a 42 L vapor container. A restrictive flow pathway was created and maintained with the shuttle valve during filling of the liquid container with refrigerated CO2 liquid from a liquid CO2 source. The liquid container was filled to a fill pressure of 1200 psig for all tests. All of the tests were performed at various levels of residual CO2 liquid in the liquid container of the system, ranging from 5% to 65% of the container volume capacity. The results are shown in FIG. 4. All tests indicated that the total amount of CO2 in the system was below 68 wt % total based on water weight regardless of the amount of residual CO2 in the liquid container prior to filling.

The results indicate that the conventional dispensing system and method of Comparative Example 1 failed to preferentially consume CO2 from the vapor container, creating an operating scenario conducive for accumulation of CO2 liquid in the vapor container with subsequent or successive fills. The conclusion from the tests was that over pressurization was likely in the case of Comparative Example 1, but significantly reduced or eliminated with the system and method of Example 1; and that the inventive system was capable of not exceeding maximum permitted filling regulatory requirements as demonstrated in Example 2.

While it has been shown and described what is considered to be certain embodiments of the invention, it will, of course, be understood that various modifications and changes in form or detail can readily be made without departing from the spirit and scope of the invention. It is, therefore, intended that the present invention not be limited to the exact form and detail herein shown and described, nor to anything less than the whole of the invention herein disclosed and hereinafter claimed. For example, pressure gauges, pressure relief valves and pressure differential devices may be integrated or built into the valve 4. Additionally, valve 4 may be connected to the valve of liquid container 1 through a flexible hose or it may be installed on liquid container 1 directly without using a cylinder valve. Other modifications to the valves 4 may be employed, such as an orifice-type structure within the shuttle valve 4. Still further, valve 4 may be replaced with another type of valve that exhibits similar functionality during filling and use of the system 10.

Additionally, the pressure regulator 9 that dispenses CO2 to an end-user or customer may be integrated or built into the shuttle valve 4. Alternatively, the pressure regulator 9 may be integrated to the vapor cylinder valve.

Other modifications and/or instrumentation are also contemplated by the present invention in addition to or independently to achieve similar control for minimizing liquid inventory within the vapor container. Specifically, the present invention can incorporate a means of measuring the liquid level in the vapor container and not permit fill when the liquid level is above a certain value. Level detection may be achieved using capacitance level gauges or optical level detection. By way of example, the monitoring of liquid level of CO2 in the vapor cylinder 2 may be used as an additional safety feature during fill and basis for controlling the amount of CO2 fluid charged into the system 10. Under normal operation, it is expected that the target fill pressure is achieved prior to the liquid level in the vapor cylinder 2 attaining a predetermined maximum liquid level. However, in the event that the system 10 is not operating under normal operating conditions during fill such that a predetermined maximum liquid level in the vapor cylinder 2 is attained that can create a hazardous condition of overpressurization, the system 10 can shut off upon reaching such predetermined maximum liquid level in the vapor cylinder 2 even though the target fill pressure has not been attained. Specifically, when the liquid level in the vapor container 2 reaches a pre-determined maximum level regardless of whether the target fill pressure has been attained, the filling operation will stop which further ensures the system 10 does not over fill. Alternatively the liquid level in the vapor container 2 may be used solely to control the fill, such that once the liquid level in the vapor cylinder 2 reaches the predetermined maximum liquid level, the fill can stop. Either control means ensures the filling operation does not continue based on attaining a predetermined maximum liquid level in the vapor cylinder 2.

In yet another example, if the fill flow rate is lower than the normal or expected fill rate, more liquid CO2 may be allowed over time (i.e., during the course of subsequent and/or successive refills) to transfer from the liquid container 1 into the vapor container 2 than may occur at the normal fill rate. The methodology of monitoring liquid level in the CO2 vapor container 2 would ensure that the filling is shut off upon detecting the predetermined maximum liquid level in the vapor cylinder 2. Still further, before filling occurs, there may be a scenario where the liquid level in the vapor cylinder 2 is at the predetermined maximum level such that filling would not be permitted to ensue. Such scenarios represent departure from normal operation conditions which can be remedied by monitoring and detecting CO2 liquid level in the vapor container 2.

Besides the level monitoring techniques described herein, the present invention also contemplates thermal imaging techniques and temperature sensitive strip techniques as the means to monitor liquid CO2 liquid levels in the vapor cylinder 2 during the filling operation when the CO2 liquid is relatively lower in temperature than that of the cylinders 1 and 2.

In one embodiment, a two-cylinder system of the present invention in which both cylinders are the same size is operated such that the maximum CO2 liquid level in the vapor cylinder 2 during fill may be controlled to be no more than 55%, preferably no more than 45% and more preferably no more than 35% based on total volume of CO2 in the system 10. The exact liquid level in the vapor cylinder 2 can vary based on the size of each of the two cylinders 1 and 2, respectively. If the vapor cylinder 2 is larger in volume capacity than the liquid cylinder 1, then the liquid level in vapor cylinder 2 can be relatively higher, provided that the total amount of CO2 in the system can't be over 68 wt % by water weight under any conditions.

Still further, load cells may be placed underneath the vapor container 2, and the fill of the liquid container 1 will be prevented unless the load cells indicate the weight of the vapor container 2 with little or no liquid phase present, e.g., tare weight plus 10 lbs maximum for a 43 L container. The 43 L container can have 14 lb CO2 even if liquid dry. The amount of CO2 allowed in the vapor cylinder can depend, at least in part, on the size of the liquid and vapor containers. For example, if the 43 L container is used for both liquid and vapor containers, 1 and 2, respectively, the vapor container 2 preferably has a maximum of approximately 40 lb CO2.

In yet an alternative design, an independent port and dip tube may be added to vent the liquid CO2 present in the vapor container during fill. The depth of the dip tube is predetermined so as to control and limit the level of liquid CO2 in the vapor cylinder. The vent line may be routed back to the CO2 source (e.g., CO2 truck) instead of open to the atmosphere. Still further, the present invention may also be modified to warm the vapor container to preferentially vaporize its CO2 liquid inventory contained therein.

Figure 3:
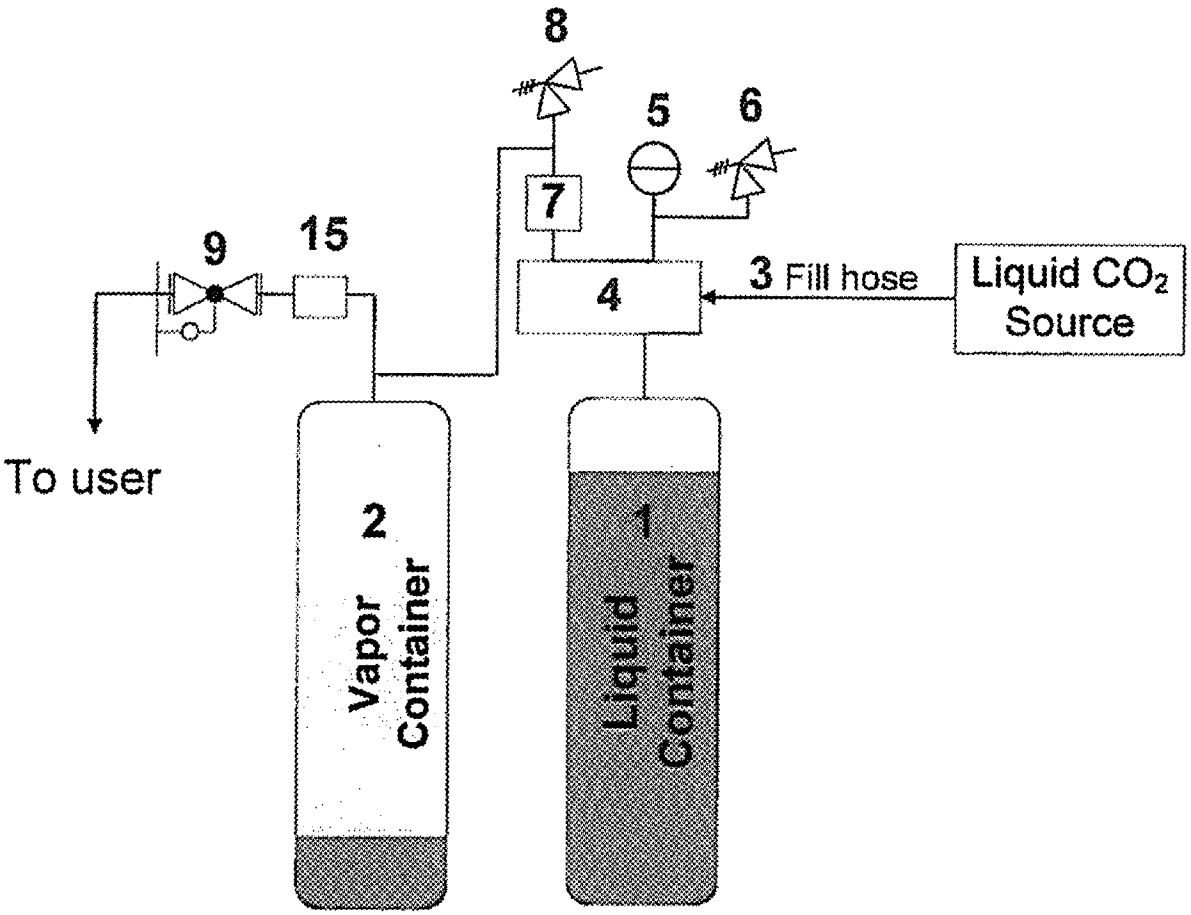
FIG. 3 is an alternative embodiment of the present invention including a residual pressure control device.

In another modification, a residual pressure control device 15, as shown in FIG. 3, may be used. The residual pressure control device 15 may be optionally integrated into the vapor cylinder valve or installed between the vapor cylinder 2 and pressure regulator 9, or between pressure differential device 7 and vapor cylinder 2. It can also be incorporated into vapor cylinder valve, supply regulator, shuttle valve, or combination. Preferably, the residual pressure control device 15 is used on the vapor supply. The residual pressure control device 15 retains a small positive pressure in the containers, e.g., 60 psig or above for the CO2 liquid and pressure containers 1 and 2. The use of the residual pressure control device 15 not only can prevent the possibility of back contamination, but can prevent dry ice formation during the fill which can occur if the pressure of the container is less than 60 psig. Accordingly, the residual pressure control device can reduce the risk of brittlement of containers 1 and 2.

It should be understood that the present invention has versatility to be employed in various applications. For example, the on-site system of the present invention can be utilized in beverage, medical, electronics, welding and other suitable applications that require on-site CO2 delivery. The present invention is also capable of filling and dispensing CO2 at any CO2 purity grade.

As has been described, the present invention contemplates several means of ensuring that sufficient headspace is provided by the vapor container. Rather than control the fill state of the liquid container as is typical with conventional systems, the present invention focuses on preserving the headspace of the vapor container by limiting CO2 fluid flow to the vapor container from the liquid container during customer usage and/or, by directly or indirectly evaluating the CO2 liquid inventory of the vapor container. As a result, the design of the present invention is aimed to reduce the likelihood of accumulating liquid CO2 in the vapor container that can possibly result in insufficient vapor headspace which is unable to accommodate liquid expansion from the liquid container after filling of the liquid container with refrigerated and pressurized CO2 liquid. As such and in this manner, the present invention represents a significant departure from conventional systems which solely focused on the contents of the liquid container, but failed to provide a solution for handling an increase in specific volume (e.g., ~30%) as a result of the temperature increase of the liquid CO2, for example, from 0° C. to 20° C. or higher.

The invention claimed is:

1. A method for filling an on-site CO2 delivery system with CO2 to avoid over pressurization, comprising the steps of:

providing a liquid CO2 container and a vapor CO2 container operatively connected to the liquid CO2 container;

introducing pressurized CO2 fluid into the liquid CO2 container;

creating a restricted flow pathway extending from a fill port to the vapor CO2 container in response to the flow of the pressurized CO2 fluid entering the liquid CO2 container;

introducing a predetermined portion of the pressurized CO2 fluid through the restricted flow pathway and into the vapor CO2 container;

filling the system with said pressurized CO2 fluid such that a total weight of said pressurized CO2 fluid occupying the system is no more than 68 wt % by water weight.

2. The method of claim 1, further comprising substantially equalizing pressures in the liquid CO2 container and the vapor CO2 container during the filling.

3. The method of claim 1, wherein a pressure differential device is configured in the open position, said pressure differential device is situated between the liquid CO2 container and the vapor CO2 container.

4. The method of claim 1, wherein the restricted flow path is created by a predetermined clearance between a valve body and the piston.

5. The method of claim 1, further comprising:

monitoring a liquid level of the pressurized CO2 fluid in the vapor CO2 container;

determining a liquid CO2 level in the vapor CO2 container to reach a predetermined maximum level, and in response thereto;

stopping the filling of the pressurized CO2 fluid into the liquid CO2 container.

6. The method of claim 1, wherein the step of introducing pressurized CO2 fluid through the restricted flow pathway and into the vapor CO2 container is in an amount that comprises less than approximately 30 wt % of the pressurized CO2 fluid introduced from a CO2 source.

7. An on-site system for selectively filling and dispensing CO2 vapor product from a liquid CO2 container and a vapor CO2 container, respectively, comprising:

a liquid CO2 container operably connected to a vapor CO2 container, the liquid CO2 container comprising a fill port to receive pressurized and refrigerated liquid CO2;

a shuttle valve comprising a reciprocating piston;

a pressure differential device situated between the liquid CO2 container and the vapor CO2 container;

the on-site system adapted to switch between a first configuration for filling and a second configuration for use;

the on-site system in the first configuration, during filling, that is defined, at least in part, by the pressure differential device activated to an open position, and the shuttle valve configured into a biased state in response to the pressurized refrigerated liquid CO2 pushing the reciprocating piston away from the fill port of the liquid container towards the vapor CO2 container, thereby unobstructing the fill port and directing a substantial fraction of the flow of the pressurized and refrigerated liquid CO2 into the liquid CO2 container while permitting a portion of the flow of the pressurized and refrigerated liquid CO2 to enter into the vapor CO2 container along a restricted flow path at a second pressure that is substantially equalized with a first pressure in the liquid CO2 container, said restricted flow path created by a clearance between a valve body of the shuttle valve and the reciprocating piston;

the on-site system in the second configuration, during use, that is defined, at least in part, by the shuttle valve in an unbiased position that allows fluid communication between the liquid CO2 container and the vapor CO2 container in an amount that is greater than that permitted by the restrictive flow path when the pressure differential device is activated to open at a predetermined pressure difference between the liquid CO2 container and the vapor CO2 container, thereby allowing CO2 fluid to transfer from the liquid CO2 container along an internal pathway of the reciprocating piston of the shuttle valve, through the pressure differential device and into the vapor CO2 container, and further wherein the pressure differential device is activated to close below the predetermined pressure difference, thereby allowing a substantial fraction of the CO2 product to be dispensed from the vapor CO2 container while (i) minimizing or eliminating the transfer of the CO2 fluid from the liquid CO2 container to the vapor CO2 container; and/or (ii) minimizing or eliminating the dispensing of CO2 vapor product from the liquid CO2 container, where either (i) or (ii) is defined as occurring prior to a subsequent or successive refill of CO2 liquid into the liquid CO2 container or a transfer of CO2 fluid from the liquid CO2 container to the vapor CO2 container.

8. The on-site system of claim 7, wherein the pressure differential device is integrated with the shuttle valve.

9. The on-site system of claim 7, wherein the restricted flow path has the clearance between the valve body and the reciprocating piston that is no more than about 0.003 inches to create less than about 25 wt % of the total $CO_2$ pressurized and refrigerated liquid $CO_2$ that is charged into the system to enter into the vapor $CO_2$ container with the balance charged to occupy the liquid $CO_2$ container.

10. The on-site system of claim 7, wherein the pressure differential device is selected from the group consisting of a critical orifice, a capillary, a pressure relief valve, an active in-line spring-loaded backpressure device and any other suitable device capable of being set to activate into an open position at the predetermined pressure difference between the liquid container and the vapor container so as to maintain transfer of the $CO_2$ fluid from the liquid $CO_2$ container to the vapor container upon preferential depletion of the $CO_2$ liquid in the vapor $CO_2$ container.

11. The on-site system of claim 7, further comprising a flow leg extending between the liquid $CO_2$ container and the vapor $CO_2$ container.

12. The on-site system of claim 11, wherein the shuttle valve and the pressure differential device is situated on the flow leg.

13. The on-site system of claim 7, further comprising a means for measuring the pressurized refrigerated $CO_2$ liquid level in the vapor $CO_2$ container.

14. The on-site system of claim 7, wherein the vapor $CO_2$ container is configured to be the same size or larger in volume than the liquid $CO_2$ container.

15. The on-site system of claim 7, further comprising a residual pressure control device.

16. A method for assembling an on-site multiple container system capable of dispensing $CO_2$ vapor product to an end-user or customer, comprising:

providing a liquid $CO_2$ container, the liquid $CO_2$ container comprising a fill port to receive pressurized refrigerated liquid $CO_2$;

providing a vapor $CO_2$ container that is the same size or larger than the liquid $CO_2$ container;

providing a pressure differential device;

providing a shuttle valve comprising a reciprocating piston;

operably connecting the liquid $CO_2$ container with the vapor $CO_2$ container with a conduit extending between the liquid $CO_2$ container and the vapor $CO_2$ container;

configuring the shuttle valve along the conduit extending between the liquid $CO_2$ container and the vapor $CO_2$ container, wherein the shuttle valve is configured into a biased state during filling of the liquid $CO_2$ container in response to receiving pressurized refrigerated liquid $CO_2$ along the fill port whereby the pressurized refrigerated liquid $CO_2$ pushes the reciprocating piston away from the fill port of the liquid container towards the vapor $CO_2$ container, thereby unobstructing the fill port and directing a substantial fraction of the flow of the pressurized refrigerated liquid $CO_2$ into the liquid $CO_2$ container, while permitting a portion of the flow of the pressurized refrigerated liquid $CO_2$ along a restricted flow pathway to enter into the vapor $CO_2$ container at a second pressure that is substantially equalized with a first pressure in the liquid $CO_2$ container, said restricted flow path created by a clearance between a valve body of the shuttle valve;

configuring the pressure differential device along the conduit extending between the liquid $CO_2$ container and the vapor $CO_2$ container; such that the pressure differential device opens and closes under certain operating conditions, wherein the pressure differential device is set to open at a predetermined pressure difference between the liquid $CO_2$ container and the vapor container thereby allowing $CO_2$ fluid to transfer from the liquid $CO_2$ container along an internal pathway of the reciprocating piston of the shuttle valve and into the vapor $CO_2$ container, and further wherein the pressure differential device is activated to close below the predetermined pressure difference, thereby preventing the transfer of the $CO_2$ fluid from the liquid $CO_2$ container to the vapor $CO_2$ container so as to dispense $CO_2$ vapor from the vapor $CO_2$ container.

17. The method of assembly of claim 16, further comprising installing a fill hose to the fill port and connecting a $CO_2$ pressurized refrigerated source to the fill hose.

18. The method of assembly of claim 16, further comprising installing a residual pressure control device.

19. The method of assembly of claim 16, further comprising installing a pressure regulator operably connected to the vapor $CO_2$ container.

* * * * *